US006548775B1

(12) United States Patent
Edwards

(10) Patent No.: US 6,548,775 B1
(45) Date of Patent: Apr. 15, 2003

(54) PADDLE FLOW MONITORING DEVICE

(75) Inventor: Paul K. Edwards, Norwich (GB)

(73) Assignee: Breed Automotive Technology, Inc., Lakeland, FL (US)

( * ) Notice: Subject to any disclaimer, the term of this patent is extended or adjusted under 35 U.S.C. 154(b) by 0 days.

(21) Appl. No.: 10/175,957

(22) Filed: Jun. 21, 2002

(51) Int. Cl.[7] ..... H01H 35/40
(52) U.S. Cl. ..... 200/81.9 M; 335/205
(58) Field of Search ..... 200/81 R, 81.9 R, 200/81.9 M; 335/205–207

(56) References Cited

U.S. PATENT DOCUMENTS

| | | | | | |
|---|---|---|---|---|---|
| 4,143,255 | A | * | 3/1979 | Herscovitz | 200/81.9 M |
| 4,282,413 | A | * | 8/1981 | Simons et al. | 200/81.9 M |
| 4,600,034 | A | * | 7/1986 | Ko | 200/81.9 M |
| 4,625,565 | A | | 12/1986 | Wada et al. | 73/861.74 |
| 4,791,254 | A | | 12/1988 | Polverari | 200/81.9 M |
| 4,827,092 | A | | 5/1989 | Kobold | 200/81.9 M |
| 4,848,926 | A | | 7/1989 | Jenkins | 374/142 |
| 4,906,807 | A | | 3/1990 | Siebert et al. | 200/81.9 M |
| 5,021,619 | A | | 6/1991 | Hutchinson | 200/81.9 M |
| 5,056,373 | A | | 10/1991 | Gray | 73/861.71 |
| 5,091,912 | A | | 2/1992 | Van Fossen | 200/81.9 M |
| 5,183,983 | A | | 2/1993 | Knopp | 800/81.9 M |
| 5,945,608 | A | | 8/1999 | Hutchinson | 73/861.24 |
| 6,032,540 | A | | 3/2000 | Hawkins | 73/861.75 |

* cited by examiner

*Primary Examiner*—Michael Friedhofer
(74) *Attorney, Agent, or Firm*—Patrick Steinnon

(57) ABSTRACT

A flow sensor has a paddle assembly that is mounted to a housing by opposed pivot posts which extend from the paddle assembly between the paddle and the magnet. The housing has two pivot post clips that resiliently capture the pivot posts which are received in mounting holes in resilient clips A shroud surrounds the housing and positions a biasing magnet which repels the magnet on the paddle assembly. The shroud slides over the housing and provides a transverse passageway that is aligned with a passageway in the housing. An activation sensor positioned within a sleeve is positioned within the transverse passageway of the housing and passes through a transverse passageway in the shroud pinning the two subassemblies together.

14 Claims, 4 Drawing Sheets

PADDLE FLOW MONITORING DEVICE

BACKGROUND OF THE INVENTION

The present invention relates to flow meters in general, and in particular to flow meters employing a paddle perpendicular to the direction of measured flow.

Devices that sense the flow of water in an essentially binary manner, i.e. determining whether flow is or is not present, are used in many systems which handle water, for example, boilers, shower pumps, and water tanks. In many instances, equipment may be damaged if it continues to operate when water is not flowing. A water pump, for example, may overheat if no water is flowing. A class of devices which may be referred to as paddle flow sensors provide a simple reliable mechanism for detecting water flow. Such a device has a pivot arm, on one end of which is a paddle and on the other end of which is a magnet. The paddle extends into a pipe so that water flowing in the pipe presses against the paddle, causing the magnet opposite the paddle to move and to thereby activate a reed switch. For example, U.S. Pat. No. 5,183,983 teaches a vane assembly that is pivotally mounted to a pin and has a portion which extends downwardly into a flow pipe. The portion of a vane assembly opposite the portion that extends into the flow pipe has a magnet that moves in response to water pressure against the downwardly extending portion. Motion of the magnet causes a reed switch to change state from open to closed, or from closed to open, depending upon the adjustable position of the reed switch.

Although such flow indicating switches are widely used, there is a need for greater simplicity in their assembly and construction and adaptability to function with various magnetic field sensors, which could provide more than binary flow information.

SUMMARY OF THE INVENTION

The flow sensor of the present invention is constructed largely of plastic, especially those components that come into contact with water. Typically all materials which come into contact with water will meet the various regulatory requirements for materials coming into contact with potable water. The flow sensor is constructed of relatively few parts that are assembled with a minimum of fasteners. The flow sensor has a paddle assembly that has a paddle at one end and an activation magnet at the other end. The paddle assembly is pivotally mounted to a housing by opposed pivot posts that extend from the paddle assembly between the paddle and the magnet. The housing has two resilient pivot post clips integrally formed with the housing. The paddle assembly is assembled to the housing by sliding the opposed pivot posts along grooves in the pivot post clips until the posts are received in mounting holes, whereupon the pivot post clips resiliently spring inwardly to capture the pivot posts and thus the paddle assembly. The housing is attached by a compression nut to a pipe fitting on a pipe through which water flow is to be monitored. A shroud surrounds the housing and positions a biasing magnet which repels the magnet on the paddle assembly, holding the paddle assembly in the non-activated position when water is not pressing on the paddle. The shroud slides over the housing and provides a transverse passageway that is aligned with a passageway in the housing. An activation sensor within a sleeve is positioned within the transverse passageway of the housing and passes through the transverse passageway of the shroud pinning the two subassemblies together. The sleeve is held in one of two positions on the shroud by an e-clip. The e-clip, by fixing the sleeve to the shroud, also pins the shroud to the housing. The sensor within the sleeve may be a reed switch, and is positioned by the sleeve and the e-clip so that motion of the activation magnet mounted on the paddle assembly causes the reed switch to change state, from closed to open or from open to closed.

It is a feature of the present invention to provide a flow sensor with simplified construction.

It is a further feature of the present invention to provide a flow sensor that is resistant to wet and dusty environments.

It is another feature of the present invention to provide a flow sensor that can be adjusted in the field.

It is a yet further feature of the present invention to provide a flow sensor that can be assembled with a minimum of fasteners.

Further features and advantages of the invention will be apparent from the following detailed description when taken in conjunction with the accompanying drawings.

BRIEF DESCRIPTION OF THE DRAWINGS

FIG. 4(*a*) is a fragmentary exploded detail of the flow sensor of FIG. 4.

DETAILED DESCRIPTION OF THE INVENTION

Figure 1:
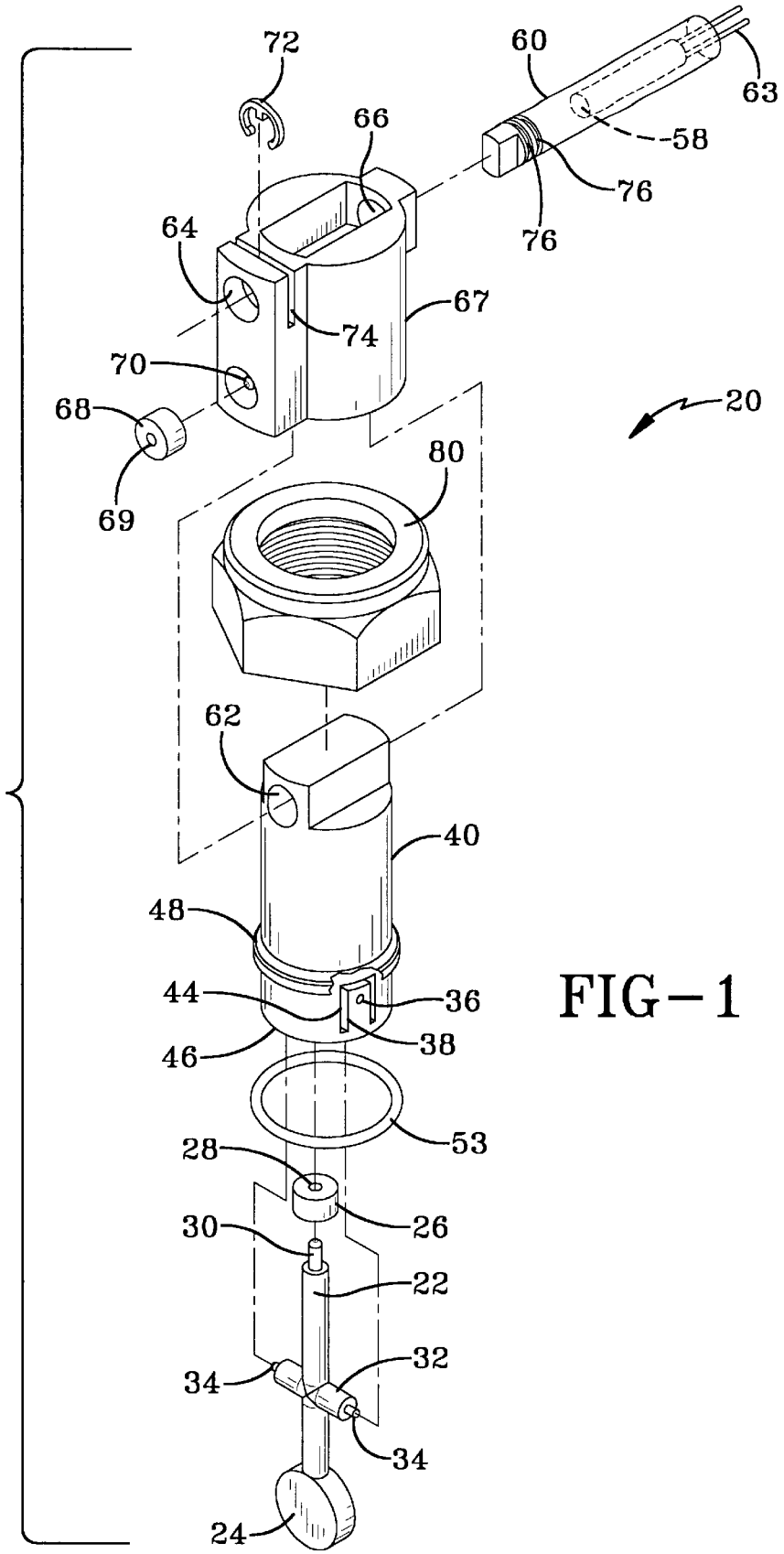
FIG. 1 is an exploded isometric view of the flow sensor of the present invention.
Figure 2:
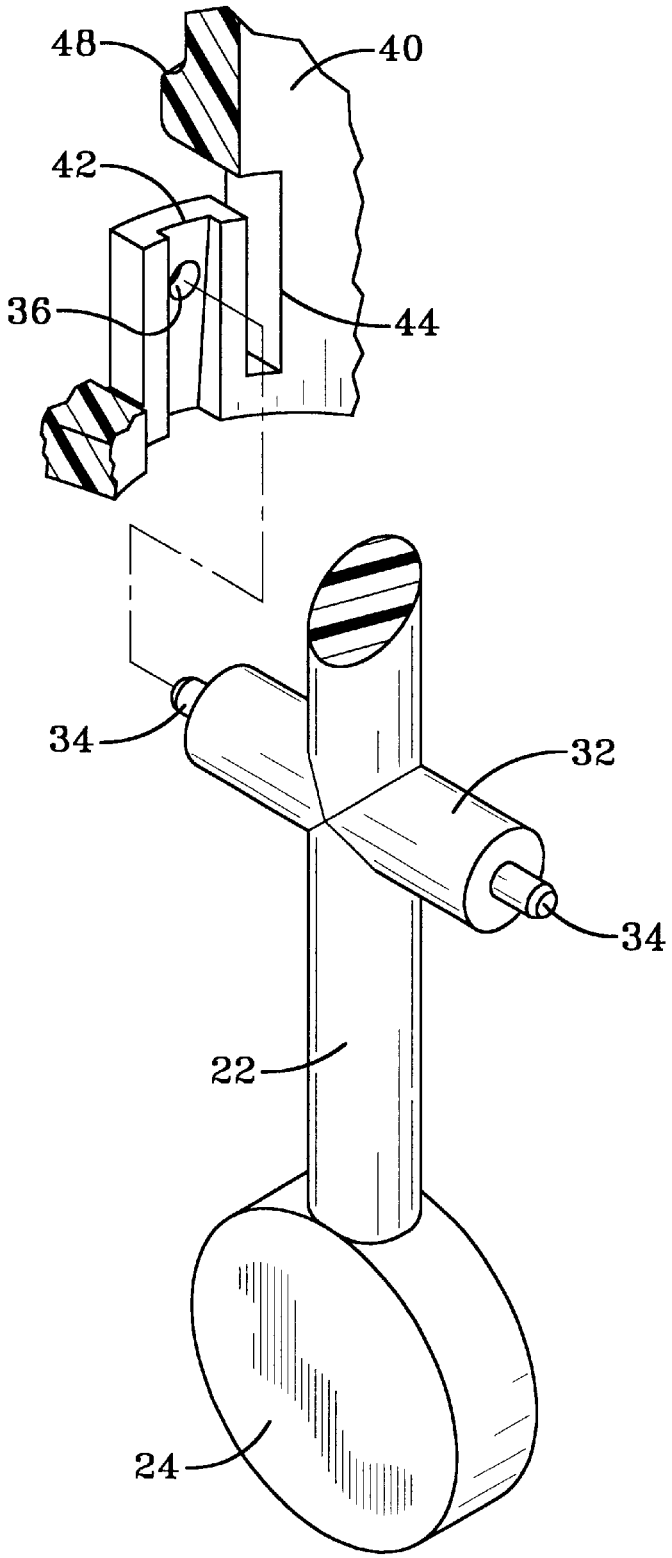
FIG. 2 is a fragmentary partially cut-away exploded detail of the flow sensor of FIG. 1.
Figure 3:
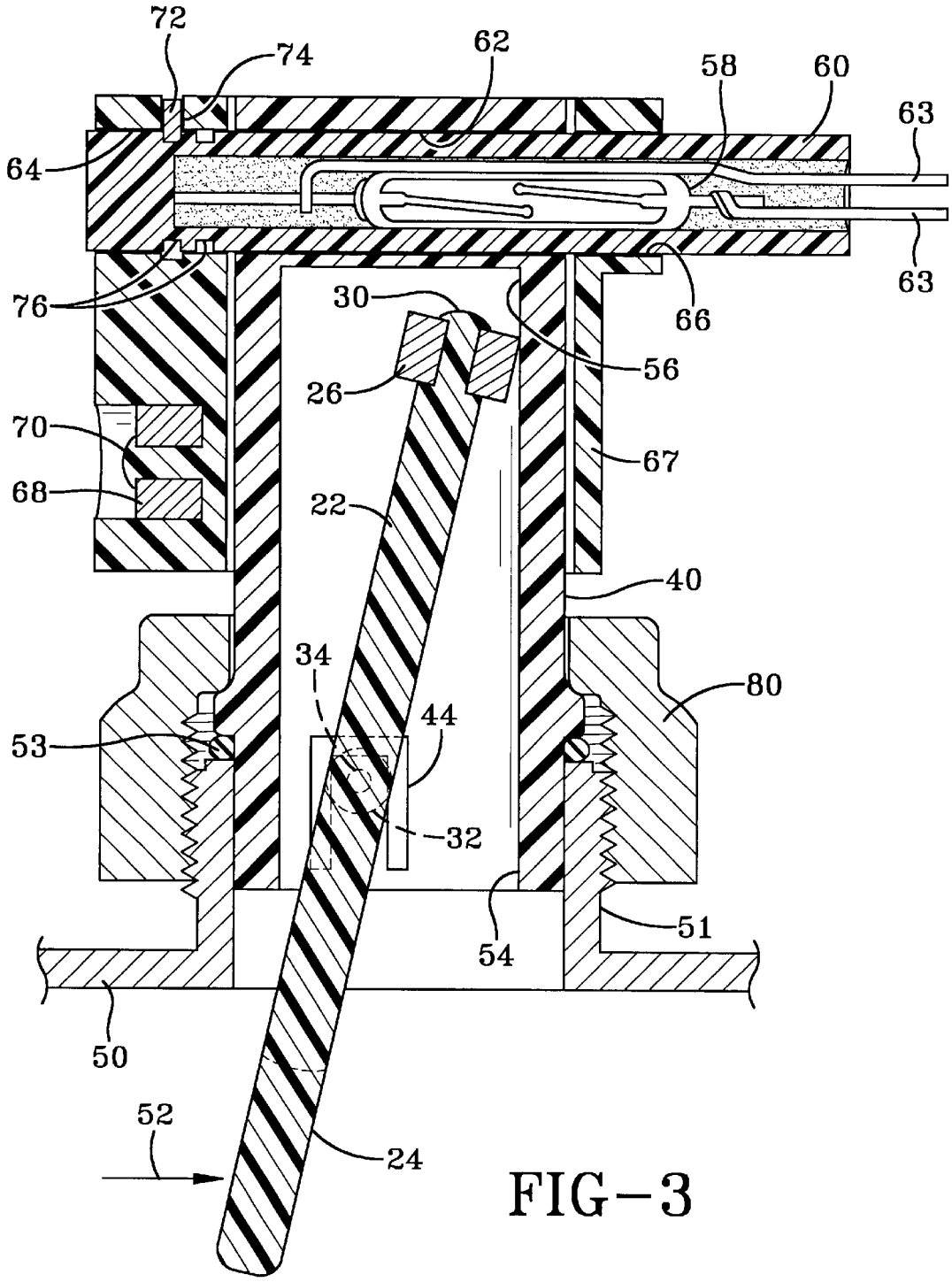
FIG. 3 is a side elevation cross-sectional view of the flow sensor of FIG. 1.
Figure 4:
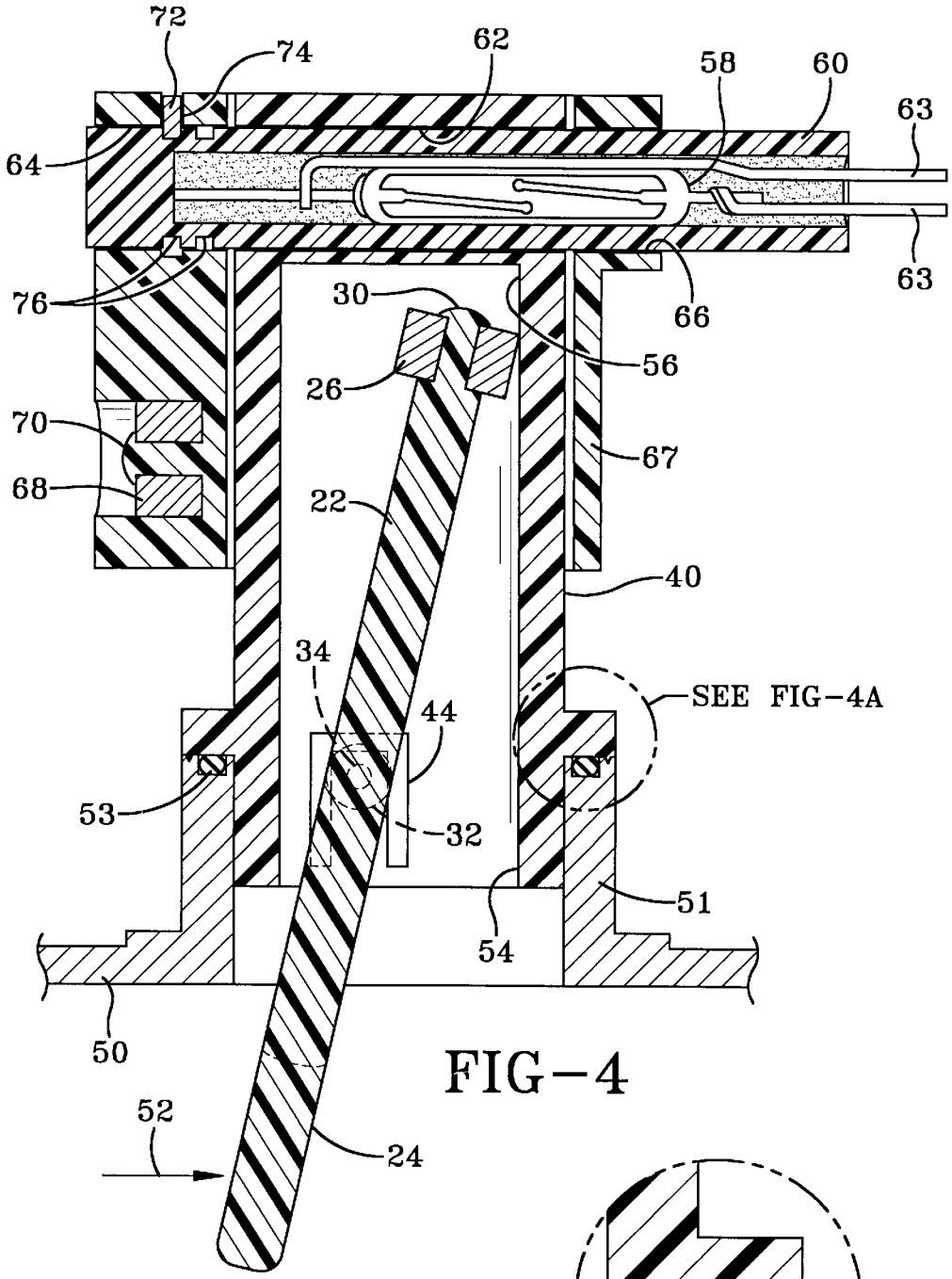
FIG. 4 is a side elevation cross-sectional view of an altgonatire embodiment of the flow sensor.
Figure 4A:
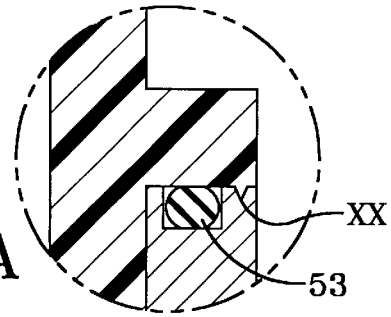

Referring more particularly to FIGS. 1–3, wherein like numbers refer to similar parts, a flow sensor 20 is shown in FIGS. 1 and 2. The sensor has a paddle assembly 22 that has a paddle 24 at one end, and an activation magnet 26 at the other end. The activation magnet 26 has a central opening 28 that is positioned over a post 30. The post 30 is heat staked as shown in FIG. 3 to fix the magnet 26 to the paddle assembly 22.

A pivot shaft 32 is positioned between the paddle 24 and the activation magnet 26. The pivot shaft 32 terminates in opposed pivot posts 34. The pivot posts 34, as shown in FIG. 2, are fixedly positioned within holes 36 in two opposed pivot post clips 38 which are integrally formed with a housing 40. The pivot posts 34 are slid along tapered grooves 42 in the pivot posts 34 until they engage the holes 36. Each pivot post 34 is defined by a U-shaped relieved portion 44 in the lowermost cylindrical section 46 of the housing 40 beneath a compression flange 48. The pivot posts 34 flex outwardly to allow the paddle assembly 22 to be pivotally mounted. In use, the flow sensor 20 is mounted within a pipe fitting 51 which prevents the pivot post clips 38 from moving outwardly, thus trapping the paddle assembly 22 between the pivot posts clips. An O-ring 53 is positioned between the compression flange 48 and the pipe fitting 51 to effect a tight seal.

Fluid pressure in a pipe 50, as shown by arrow 52, causes the paddle assembly 22 to rotate about the pivot shaft 32 and the pivot posts 34 so that the activation magnet 26 positioned within the interior 54 of the housing 40 rotates away from the distal wall 56. A reed switch 58 is positioned within a cylindrical sensor housing sleeve 60 that is received within a transverse passageway 62 in the housing 40. The reed switch 58 is positioned so that motion of the activation magnet 26 causes the reed switch 58 to change state: either opening or closing. The reed switch 58, as shown in FIG. 3, may be potted with potting compound, such as epoxy or polyurethane, within the sleeve 60. Leads 63 extend from the sleeve 60 and may be connected to a connector (not shown).

The sleeve 60, in addition to passing through the transverse passage 64 of the housing 40, also passes through transverse openings 64, 66 in a shroud 67 on which is positioned a biasing magnet 68. The shroud 67 and magnet 68 are thereby attached or pined to the housing 40 by the sleeve 60. The biasing magnet 68 has a central hole 69 therein which fits over a post 70 which is heated staked as shown in FIG. 3 to hold the biasing magnet 68 into a position that is sufficiently distant from the reed switch 58 so as not to effect the reed switch, while sufficiently close to the activation magnet 26 to bias it towards the distal wall 56. The sleeve 60 pins the shroud 67 to the housing 40. The sleeve 60 is held in position by an e-clip 72 that fits within the slot 74 in the shroud 67 across the transverse opening 64. The sleeve 60 has two circumferential grooves 76 with which the e-clip may engage, so that the reed switch 58 may be positioned to be normally open or normally closed by the end user of the flow sensor 20. The entire sleeve 60 may also be replaced by the end user to change the type of reed switch or other sensor used with the flow sensor 20.

The sensor housing sleeve 60 may also contain a circuitboard (not shown) on which is mounted a Hall effect sensor or a GMR sensor. If a Hall effect sensor is used it may be the standard digital pulsing type, or analog type, or a latching sensor depending on the requirements of the user of the flow sensor 20. If a Hall effect sensor or GMR sensor is used, more than simple binary information would be available from the flow sensor 20 if desired. Information such as how the paddle assembly 22 moves in response to the beginning of flow could be used for diagnostic purposes, or sensor data concerning paddle assembly position could be used to monitor flow rate in the pipe 50.

The flow sensor 20 has a single moving part, the paddle assembly 22, which is exposed to water. All the components of the flow sensor 20 are formed of plastic except for the magnets, which are formed of hard ferrite; the compression nut 80, which is formed of brass; and the e-clip, which is formed of 316 stainless steel. The paddle assembly is constructed of POM Acetyl. The sleeve 60 and the shroud 67, may be of Nylon 6,6, although the shroud 67 may also be PPO (Modified Polyphenylene Oxide) or PPS (Polyphenylene Sulfide). The housing is constructed of PPO (Modified Polyphenylene Oxide) which is sold under the trade name Noryl®. The sensor reed switch may be a reed switch such as is available from Hamlin (www.hamlin.com/switchindex.htm). The particular type employed will depend on the end user of the sensor 20.

A standard is defined by BS EN 60529 for the notation of level of protection provided by enclosures of electrical equipment against the environment. The sensor housing sleeve 60, with the encapsulated sensor and the overall construction of the flow sensor 20 allows a sensor in accordance with this disclosure to be built to the IP67 standard.

It should be understood that the sensor 20 housing 40 can be mounted to a pipe fitting by any one of several techniques including spin welding, ultrasonic welding, heat staking, and laser welding, or by other known techniques or more generally by any technique which is developed for joining plumbing type fixtures.

It should also be understood that the e-clip 72 could be used with any number of circumferential grooves 76 on the sleeve 60 to adjust the sensitivity or position of the reed switch 58 or of another sensor such as a Hall effect or GMR sensor.

It should also be understood that the activation magnet 26 could be attached to the paddle assembly 22 by various methods other than heat staking, including clip fitting. And it should be understood that the biasing magnet 68 could be encapsulated within the shroud 67. It should further be understood that the nonactivated position of the paddle refers to the position, for example as illustrated in FIG. 3, of the paddle 24 when water is not flowing in the pipe 50.

It is understood that the invention is not limited to the particular construction and arrangement of parts herein illustrated and described, but embraces all such modified forms thereof as come within the scope of the following claims.

I claim:

1. A flow sensor comprising:

a paddle assembly having a paddle at a first end, an activation magnet on a second end, and a pivot shaft positioned between the first end and the second end;

a housing, the paddle assembly being mounted on the housing to pivot about the pivot shaft;

a shroud surrounding a portion of the housing;

a biasing magnet positioned on the shroud to repel the activation magnet on the paddle assembly to hold the paddle assembly in a nonactivated position when water is not pressing on the paddle, the shroud sliding over the housing and having a transverse passageway which is aligned with a transverse passageway in the housing; and an activation sensor positioned within a sleeve, the sleeve slidably positioned within the transverse passageway of the housing and passing through the transverse passageway of the shroud to pin the housing and the shroud together.

2. The sensor of claim 1 further comprising:

a flange on the housing, the flange positioned above the pivot shaft; and a compression nut positioned about the flange on the housing, for compressing the flange into sealing engagement with an o-ring that engages a pipe that receives a portion of the housing below the flange.

3. The sensor of claim 1 wherein the sleeve is held in one of two positions with respect to the shroud by a clip.

4. The sensor of claim 1 wherein the activation magnet is heat staked to the paddle assembly.

5. The sensor of claim 1 wherein the biasing magnet is heat staked to the shroud.

6. A flow sensor comprising:

a paddle assembly having a paddle at a first end and an activation magnet on a second end and opposed pivot posts positioned between the first end and the second end;

a housing having portions defining two opposed resilient pivot post clips integrally formed with the housing, each of the pivot post clips having portions for receiving one of said opposed pivot posts;

wherein the paddle assembly is assembled to the housing by sliding the opposed pivot posts along the pivot post clips until the posts are received in the portions for receiving one of said opposed posts, whereupon the pivot post clips resiliently spring inwardly to capture the pivot posts and thus the paddle assembly;

a biasing magnet attached to the housing to repel the magnet on the paddle assembly and to hold the paddle assembly in a selected position when water is not pressing on the paddle; and a sensor mounted to the housing to detect motion of the activation magnet mounted to the paddle assembly.

7. The sensor of claim 6 wherein the sensor is held in one of two positions by a clip with respect to the housing.

8. The sensor of claim 6 wherein the activation magnet is heat staked to the paddle assembly.

9. The sensor of claim 6 wherein the pivot post clips have tapered grooves which guide the pivot posts to the portions for receiving said posts.

10. A flow sensor comprising:

a paddle assembly having a paddle at a first end and an activation magnet on a second end and opposed pivot posts positioned between the first end and the second end;

a housing having portions defining two opposed resilient pivot post clips integrally formed with the housing, each of the pivot post clips having portions for receiving one of said opposed pivot posts;

a flange projecting from the housing above the pivot post clips;

wherein the paddle assembly is assembled to the housing by sliding the opposed pivot posts along the pivot post clips until the posts are received in the portions for receiving one of said opposed posts, whereupon the pivot post clips resiliently spring inwardly to capture the pivot posts and thus the paddle assembly;

a pipe positioned below the housing, into which portions of the paddle extend, the pipe having a fitting which extends towards the housing flange, the fitting extending exterior to the pivot post clips;

an o-ring positioned between the housing flange and the pipe fitting;

a compression nut engaging the housing flange and the pipe fitting, and forcing the flange into sealing engagement with the o-ring;

a shroud surrounding a portion of the housing;

a biasing magnet positioned on the shroud to repel the magnet on the paddle assembly to hold the paddle assembly in the nonactivated position when water is not pressing on the paddle, the shroud sliding over the housing and having a transverse passageway which is aligned with a transverse passageway in the housing;

an activation sensor positioned within a sleeve slidably positioned within the transverse passageway of the housing and passing through the transverse passageway of the shroud to pin the housing and the shroud together.

11. The sensor of claim 10 wherein the sleeve is held in one of two positions with respect to the shroud by a clip.

12. The sensor of claim 10 wherein the activation magnet is heat staked to the paddle assembly.

13. The sensor of claim 10 wherein the biasing magnet is heat staked to the shroud.

14. The sensor of claim 10 wherein the pivot post clips have tapered grooves which guide the pivot posts to the portions for receiving said posts.

* * * * *